US007862481B2

(12) United States Patent
Chen

(10) Patent No.: US 7,862,481 B2
(45) **Date of Patent: *Jan. 4, 2011**

(54) STEPPER APPARATUS

(75) Inventor: Tsung-Jen Chen, Chiayi (TW)

(73) Assignee: Chin-Yu Tu, Chiayi (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/431,468

(22) Filed: Apr. 28, 2009

(65) Prior Publication Data

US 2010/0144495 A1 Jun. 10, 2010

(30) Foreign Application Priority Data

May 12, 2008 (TW) ..... 97208150 U

(51) Int. Cl.
*A63B 22/04* (2006.01)

(52) U.S. Cl. ..... 482/52

(58) Field of Classification Search ..... 482/51, 482/52, 53, 54, 70, 71, 148; 434/253, 255; 601/29, 31, 34, 35; D21/670
See application file for complete search history.

(56) References Cited

U.S. PATENT DOCUMENTS 6,220,990 B1 * 4/2001 Crivello ..... 482/51
6,224,515 B1 * 5/2001 Chen ..... 482/53
6,709,366 B2 * 3/2004 Chuang ..... 482/53
6,918,857 B2 * 7/2005 Chen ..... 482/53
7,108,638 B2 * 9/2006 Snyderman ..... 482/57
7,530,927 B2 * 5/2009 Chuang ..... 482/53
2004/0162193 A1 * 8/2004 Gray et al. ..... 482/70
2005/0113215 A1 * 5/2005 Chuang ..... 482/52
2006/0035756 A1 * 2/2006 Chen ..... 482/53
2007/0254782 A1 * 11/2007 Chen ..... 482/53

* cited by examiner

*Primary Examiner*—Loan Thanh
*Assistant Examiner*—Tam Nguyen
(74) *Attorney, Agent, or Firm*—Banger Shia

(57) ABSTRACT

A stepper apparatus includes a base, two axle units, two pedal units and a coordinating unit. The base includes a post formed thereon. Each of the axle units includes an axle extended downwards from a flank of the post. Each of the pedal units includes a pedal pivotally connected to the axle of a related one of the axle units. The coordinating unit includes a lever pivotally connected to the post and formed with two ends each connected to a related one of the pedals so that one of the pedals is moved upwards and outwards while the other pedal is moved downwards and inwards.

3 Claims, 9 Drawing Sheets

STEPPER APPARATUS

FIELD OF INVENTION

The present invention relates to a stepper apparatus with which a user can exercise his or her legs, buttocks and waist.

BACKGROUND OF INVENTION

A conventional stepper apparatus includes two pedals that can be pivoted up and down about horizontal axles. The movement of the pedals is limited to vertical directions. Therefore, a user can only exercise his or her legs.

Another conventional stepper apparatus includes two pedals that can be pivoted about two inclined axles extended from a post. The inclined axles and the post form a Y-shaped structure. One of the pedals will be lifted and moved towards the post if the other pedal is trodden and moved away from the post, i.e., outwards. Therefore, a user is forced to twist his or her waist while exercising his or her legs by treading the pedals. The user uses a little energy to twist his or her waist because he or she easily keeps balance while moving the pedal downwards and outwards.

The present invention is therefore intended to obviate or at least alleviate the problems encountered in prior art.

SUMMARY OF INVENTION

It is the primary objective of the present invention to provide a stepper apparatus with which a user can exercise his waist, buttocks and legs at the same time.

To achieve the foregoing objective, the stepper apparatus includes a base, two axle units, two pedal units and a coordinating unit. The base includes a post formed thereon. Each of the axle units includes an axle extended downwards from a flank of the post. Each of the pedal units includes a pedal pivotally connected to the axle of a related one of the axle units. The coordinating unit includes a lever pivotally connected to the post and formed with two ends each connected to a related one of the pedals so that one of the pedals is moved upwards and outwards while the other pedal is moved downwards and inwards.

Other objectives, advantages and features of the present invention will be apparent from the following description referring to the attached drawings.

BRIEF DESCRIPTION OF DRAWINGS

The present invention will be described via the detailed illustration of four embodiments referring to the drawings.

DETAILED DESCRIPTION OF EMBODIMENTS

Figure 1:
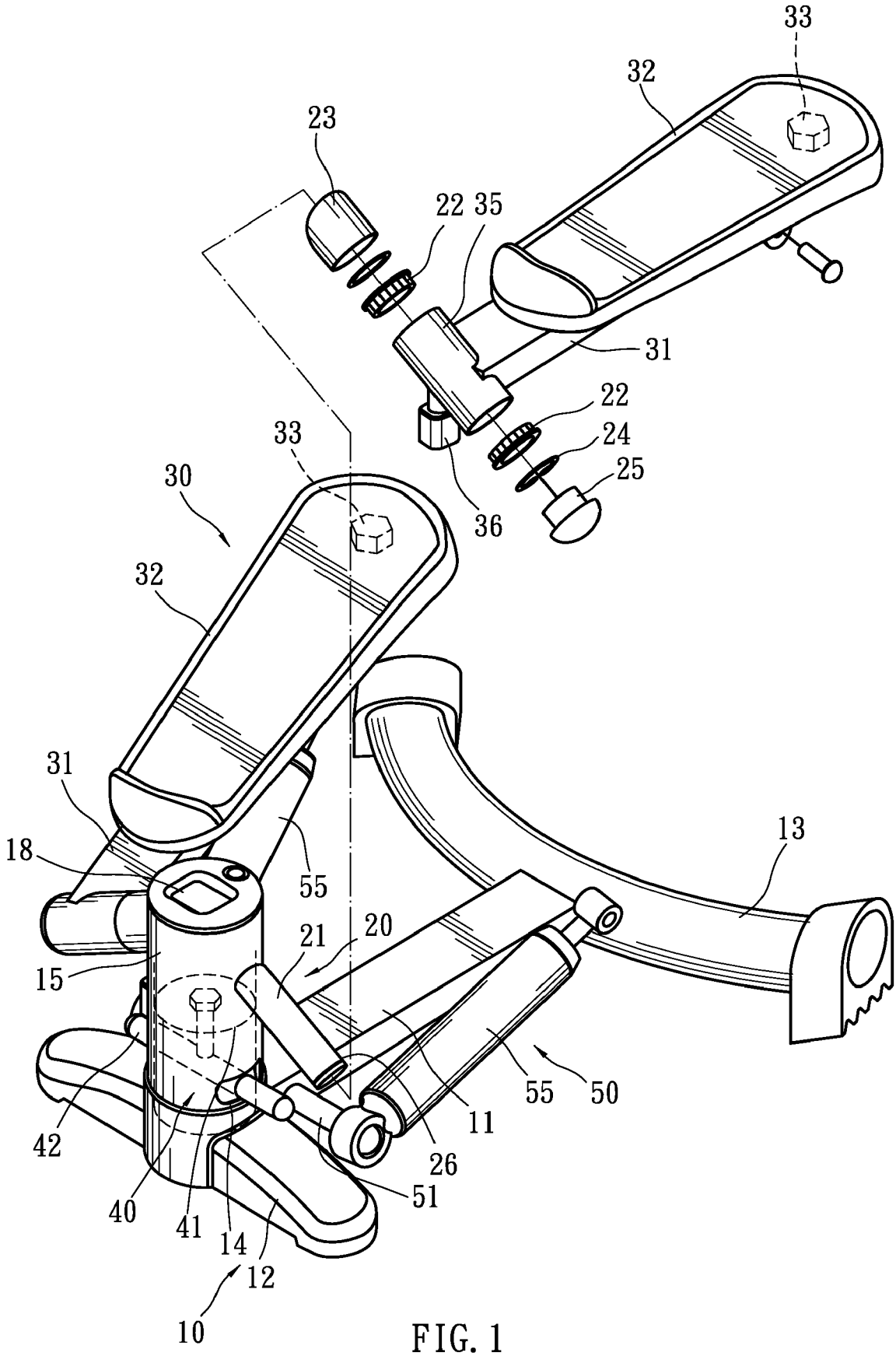
FIG. 1 is an exploded view of a stepper apparatus according to the first embodiment of the present invention.
Figure 2:
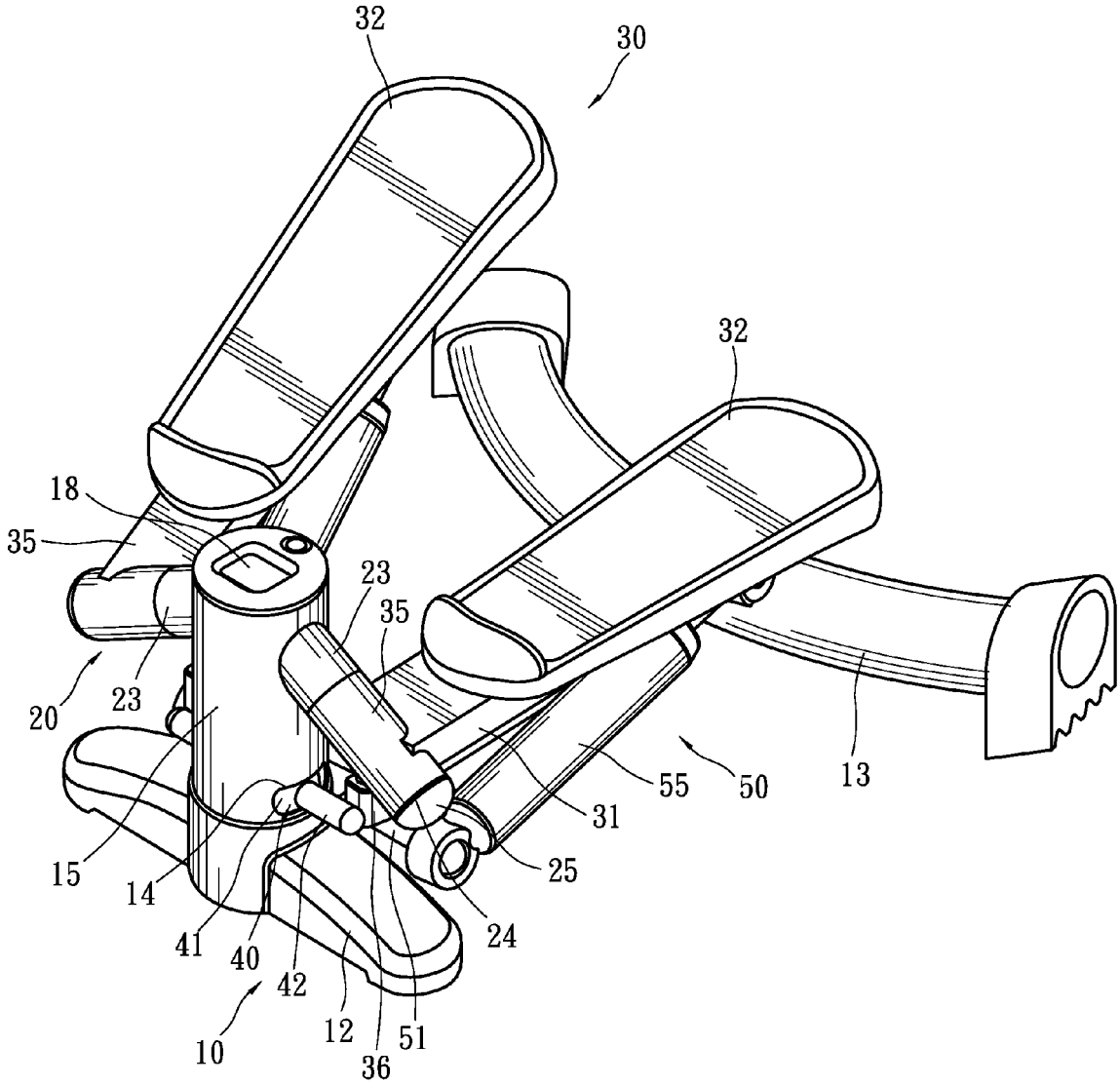
FIG. 2 is a perspective view of the stepper apparatus shown in FIG. 1.
Figure 3:
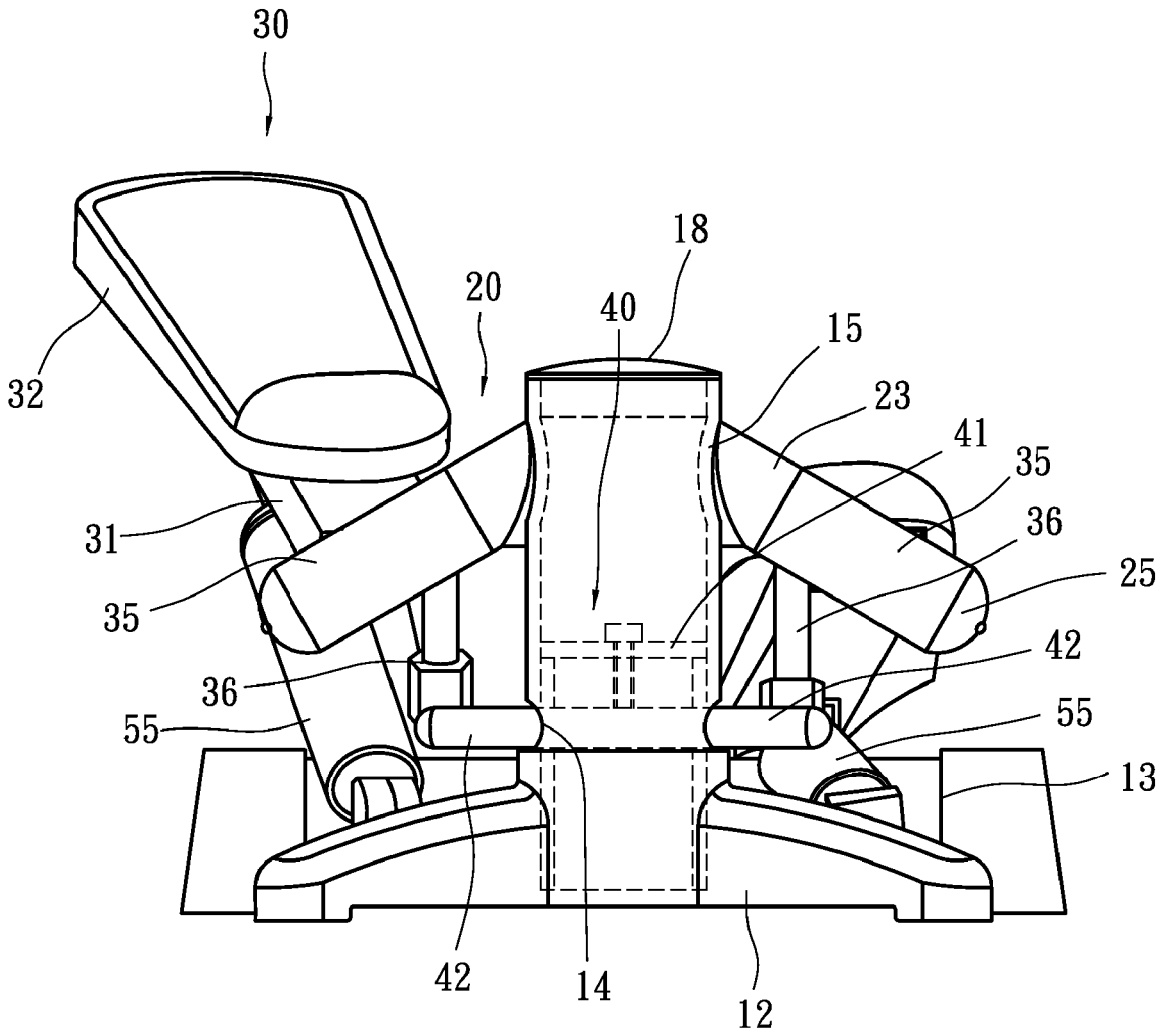
FIG. 3 is a front view of the stepper apparatus shown in FIG. 1.

Referring to FIGS. 1 through 5, a stepper apparatus includes a base 10, two axle units 20, two pedal units 30, a coordinating unit 40 and two impeding units 50 according to a first embodiment of the present invention. The base 10 includes a longitudinal bar 11 provided between two crossbars 12 and 13 and a post 15 extended from the crossbar 12. A meter 18 is provided on the post 15.

Each of the axle units 20 includes an axle 21 extended downwards from the post 15. The axle 21 includes a fixed end at the post 15 and a free end opposite to the fixed end. The free end is located lower than the fixed end.

Each of the pedal units 30 includes a sleeve 35 pivotally supported on the axle 21 of a related one of the axle units 20. A beam 31 is connected to the sleeve 35. A pedal 32 is attached to an upper side of the beam 31. A cushion 33 is attached to a lower side of the beam 31. A rod 36 is connected to a lower side of the sleeve 35.

Each of the axle units 20 further includes a spacing element 23 provided between the post 15 and one of the bearings 22, a clip 24 disposed in an annular groove 26 defined in the axle 21 to keep the bearings 22 and the sleeve 35 on the axle 21 and a cover 25 attached to the free end of the axle 21.

The coordinating unit 40 includes a shaft 41 rotationally inserted in the post 15 and a lever 42 connected to the shaft 41 so that the shaft 41 and the lever 42 form a cross. The lever 42 includes two ends each extended from the shaft 41 to the exterior of the post 15 through a slot 14 defined in the post 15. Each of the ends of the lever 42 is in contact with the rod 36 of a related one of the axle units 20.

Each of the impeding units 50 includes a rod 51 and a hydraulic cylinder 55. The rod 51 is connected to the longitudinal bar 11 transversely. The hydraulic cylinder 55 includes an end connected to the rod 51 and an opposite end connected to the beam 31 of a related one of the pedal units 30. Thus, each of the impeding units 50 is used to exert impedance against the movement of a related one of the pedal units 30.

Figure 4:
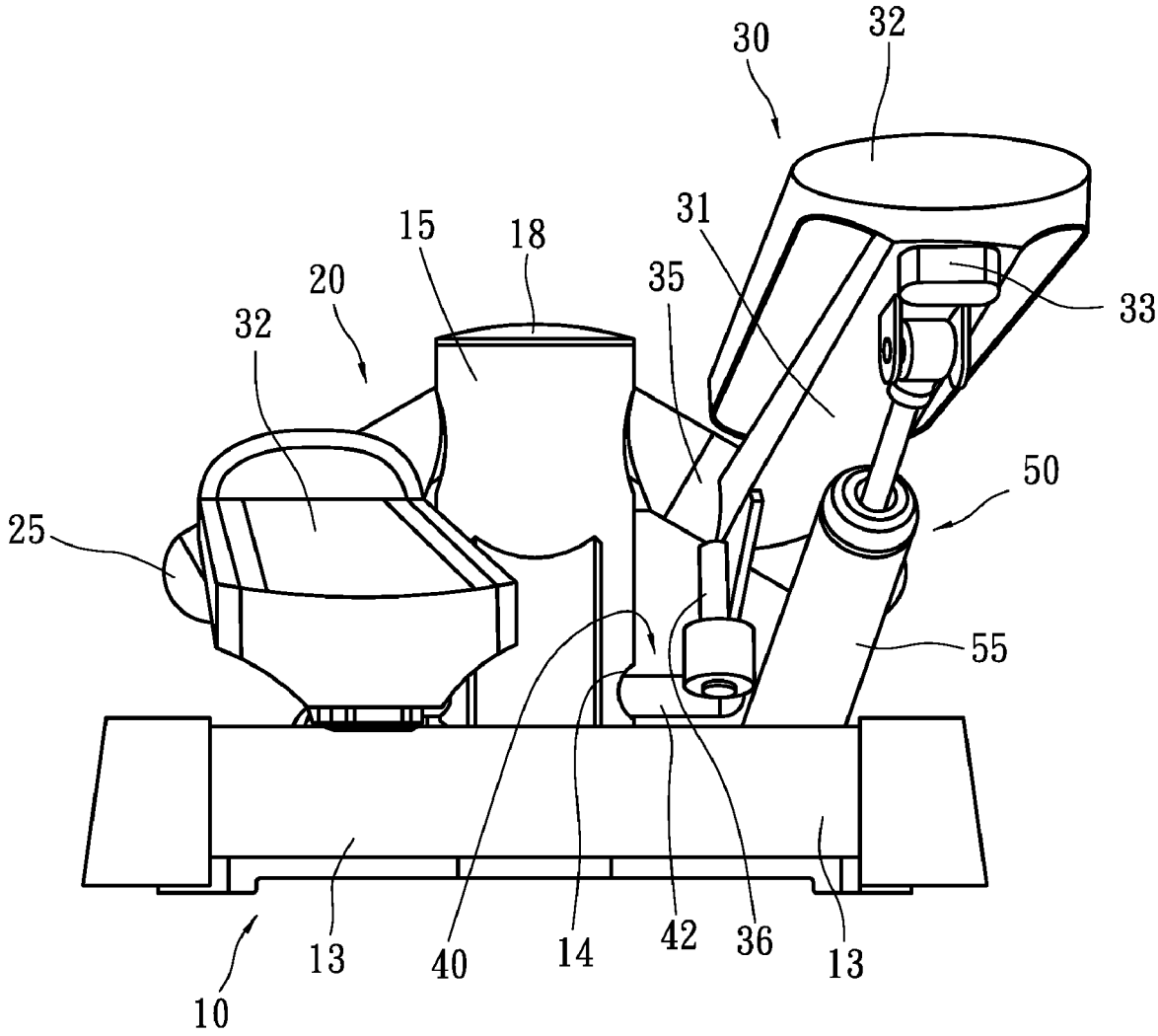
FIG. 4 is a rear view of the stepper apparatus shown in FIG. 1.
Figure 5:
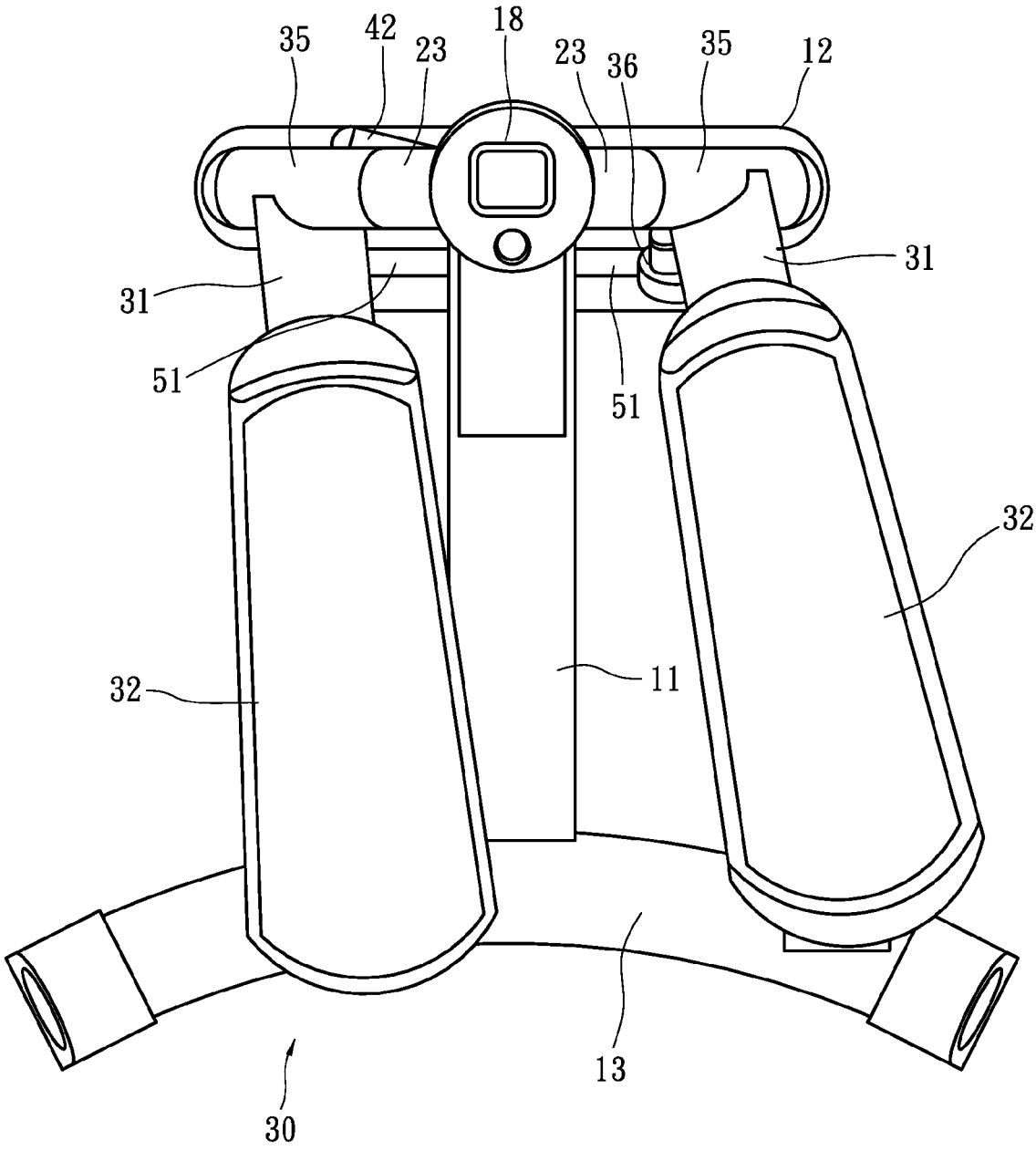
FIG. 5 is a top view of the stepper apparatus shown in FIG. 4.

Referring to FIGS. 4 and 5, the axles 21 extend downwards from the post 15 so that one of the pedals 32 is moved downwards and inwards while the other pedal 32 is moved upwards and outwards. The downward and inward movement of each of the pedals 32 causes a user to consume a lot of energy to twist his or her waist to keep balance.

Figure 6:
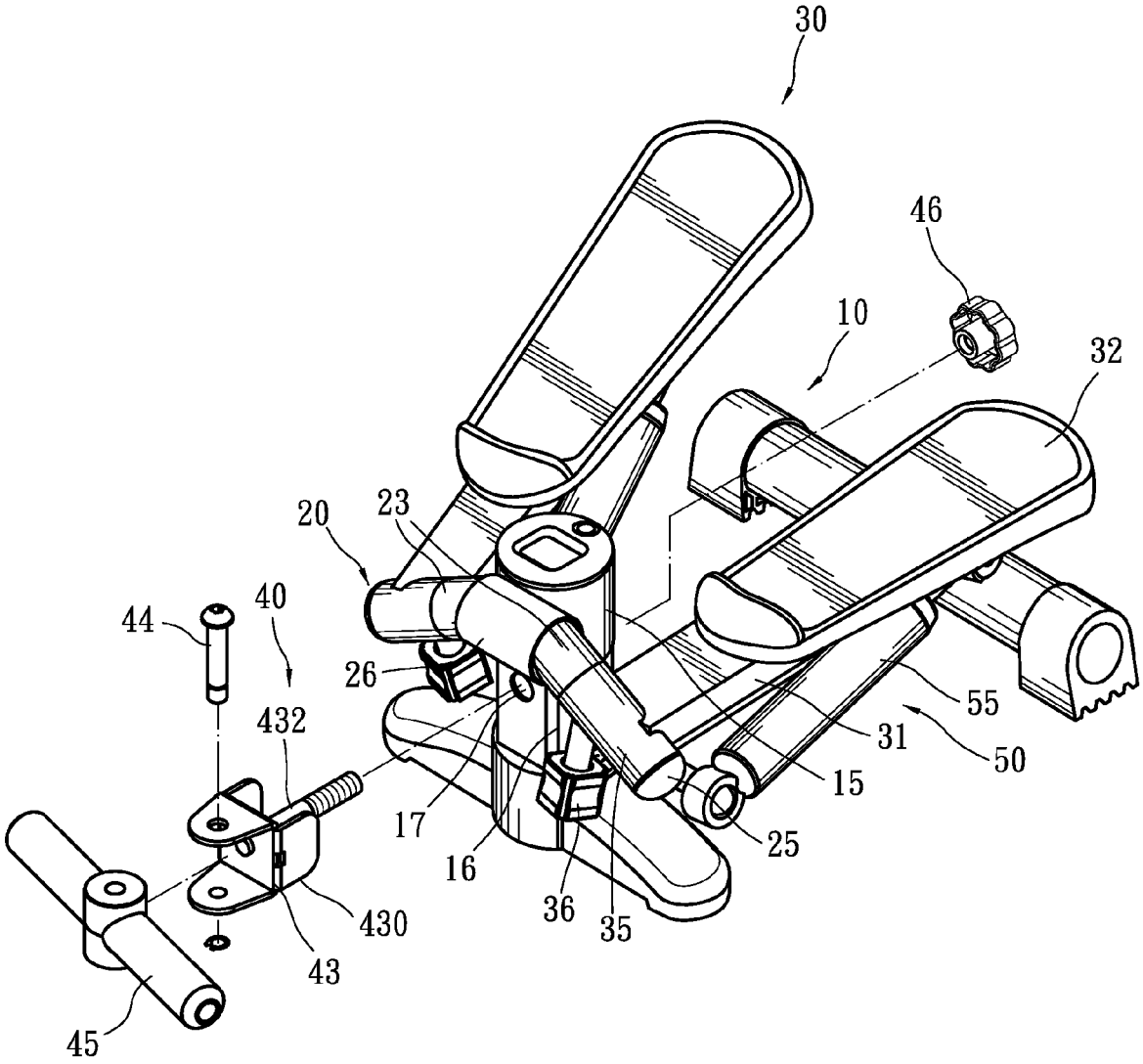
FIG. 6 is an exploded view of a stepper apparatus according to the second embodiment of the present invention.
Figure 7:
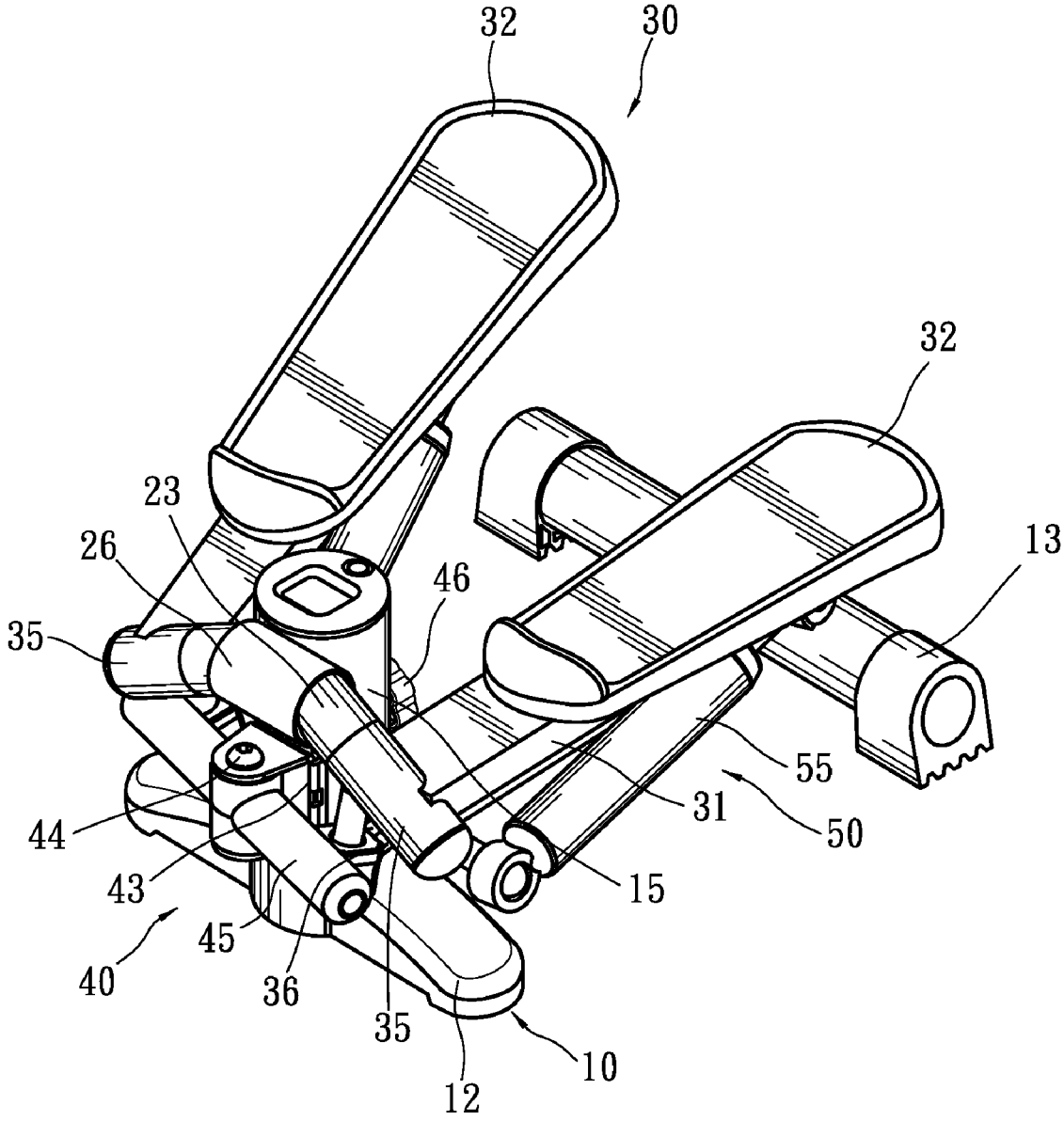
FIG. 7 is a perspective view of the stepper apparatus shown in FIG. 6.

Referring to FIGS. 6 and 7, there is shown a stepper apparatus according to a second embodiment of the present invention. The second embodiment is like the first embodiment except the following features. The coordinating unit 40 includes a connector 43 for pivotally connecting a lever 45 to the post 15. Accordingly, the shaft 41 and the lever 42 are omitted. The connector 43 includes two tabs 430 directed towards the post 15, a threaded bolt 432 directed towards the post 15 and two ears directed towards the lever 45. The post 15 includes two planar faces 16 formed on two opposite sides thereof and an aperture 17 defined therein. The tabs 430 are located against the planar faces 16 while the threaded bolt 432 is inserted through the aperture 17 and engaged with a nut/knob 46. The lever 45 is pivotally connected to the ears with a pin 44. The lever 45 is formed with two ends each in contact with the rod 36 of a related one of the pedal units 30.

Figure 8:
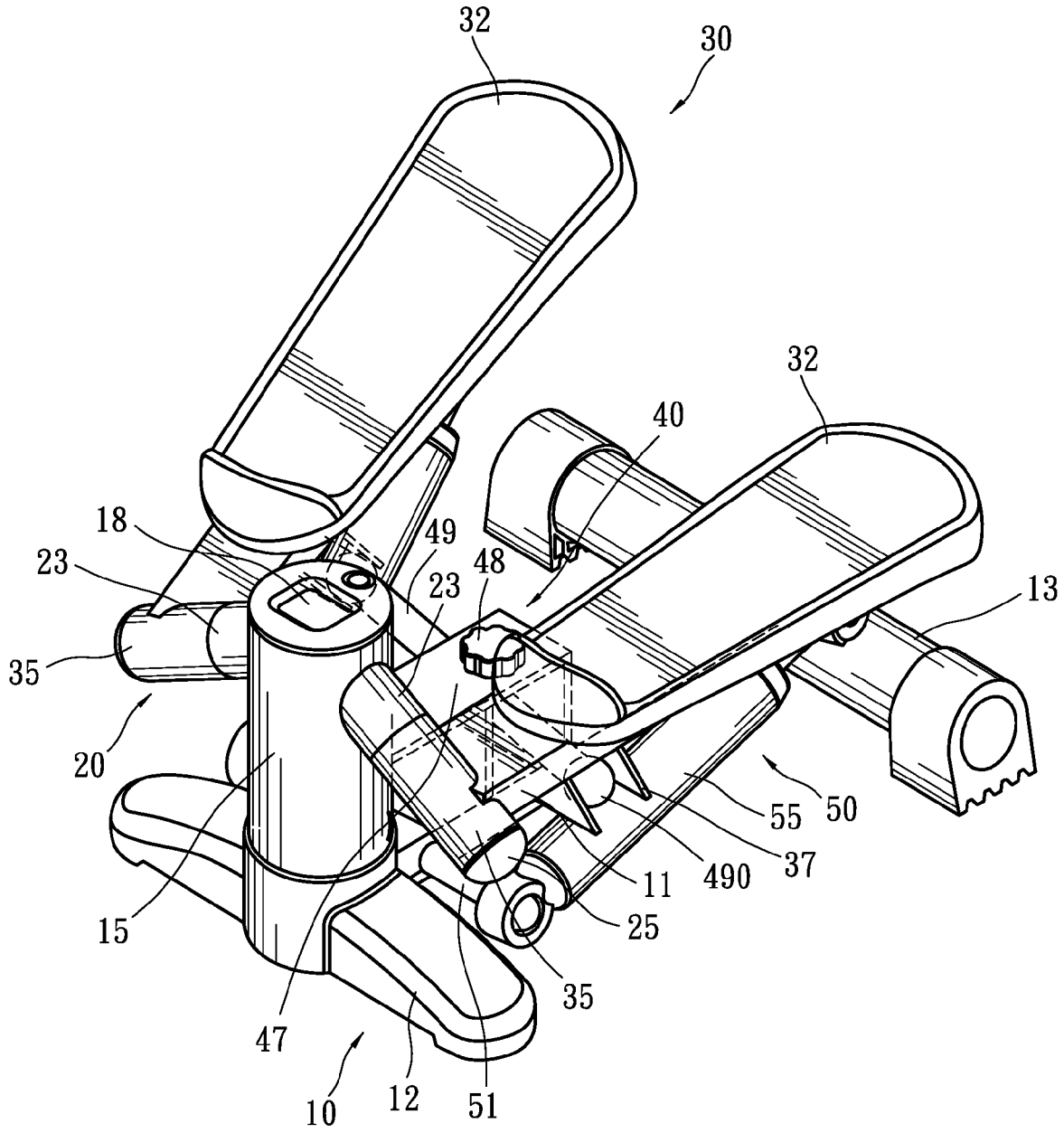
FIG. 8 is a perspective view of a stepper apparatus according to the third embodiment of the present invention.

Referring to FIG. 8, there is shown a stepper apparatus according to a third embodiment of the present invention. The third embodiment is identical to the first embodiment except the following features. The coordinating unit 40 includes a frame 47 attached to the post 15, a lever 49 pivotally supported on the frame 47 and an adjusting element 48 operable for adjusting the height of the lever 49. Accordingly, the shaft 41 and the lever 42 are omitted. The lever 49 is like a seesaw. The lever 49 includes two spherical ends 490 for smooth contact with the beams 31. The adjusting element 48 includes a knob and a threaded bolt extended from the knob. The threaded bolt is driven through a screw hole defined in the frame 47 into contact with the lever 49. The knob is operable to rotate the threaded bolt.

Figure 9:
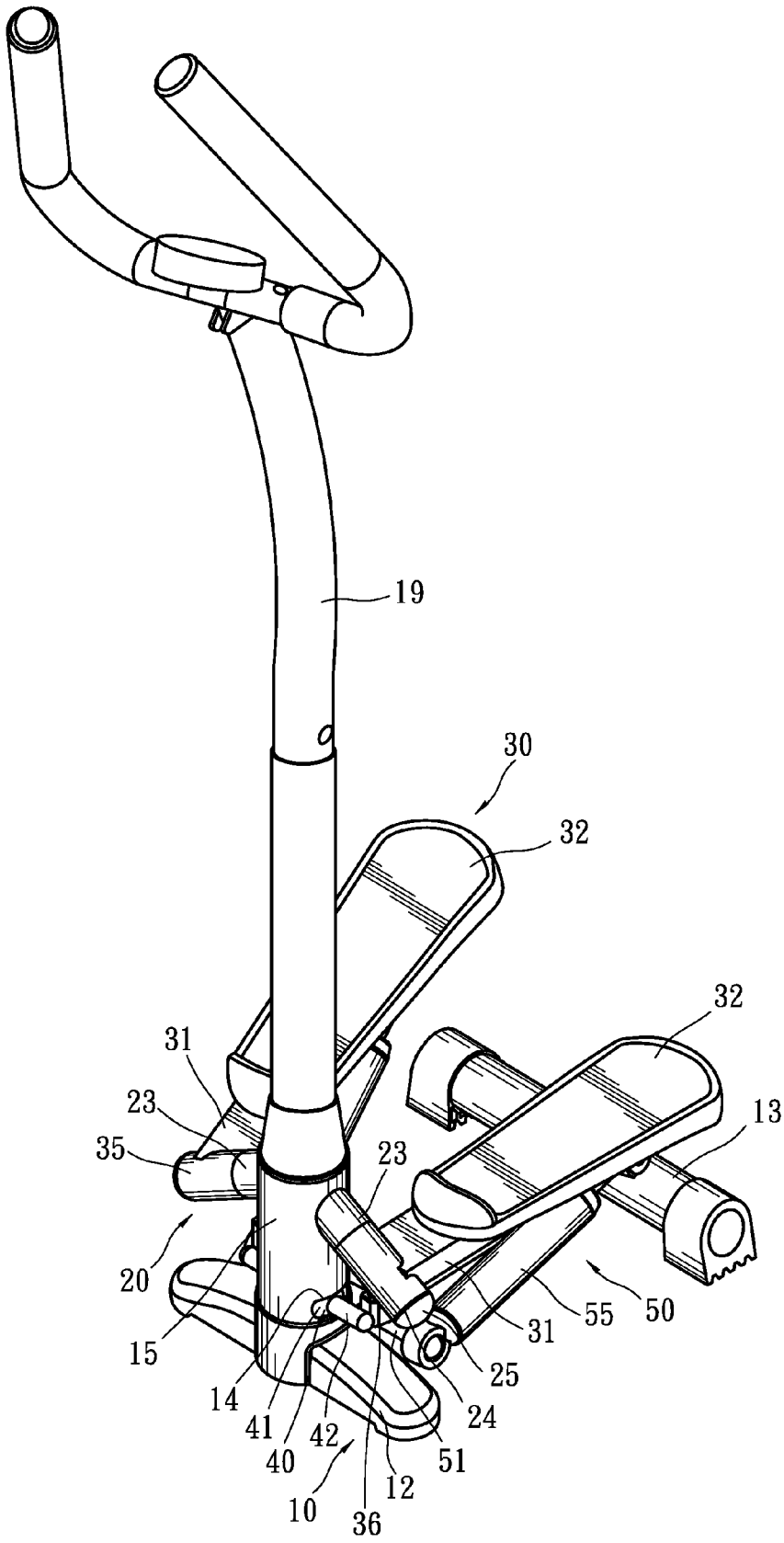
FIG. 9 is a perspective view of a stepper apparatus according to the fourth embodiment of the present invention.

Referring to FIG. 9, there is shown a stepper apparatus according to a fourth embodiment of the present invention. The fourth embodiment is like the first embodiment except including a handle 19 supported on the post 15. A child, a pregnant woven or a senior citizen can hold the handle 19 to keep balance while exercising.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A stepper apparatus comprising:

a base having an upright post formed thereon;

two axle units each having an axle extended laterally downwards from a flank of the post;

two pedal units each having a sleeve rotatably and coaxially connected to the axle of a related one of the axle units, a pedal rearwardly connected to the sleeve, and a rod extended substantially downward from the sleeve; and a coordinating unit having a lever connected to the post, the coordinating unit formed with two ends each in contact with the rod of a related one of the pedal units so that as one of the pedal units is moved upwards and laterally outwards, the other pedal unit is moved downwards and laterally inwards.

2. The stepper apparatus according to claim 1, wherein the post comprises two planar faces formed thereon and an aperture defined therein, wherein the coordinating unit includes two tabs each located against a related one of the planar faces of the post and a threaded bolt is driven through the aperture of the post and a nut engaged with the bolt to secure the coordinating unit to the post.

3. The stepper apparatus according to claim 1, wherein each of the pedal units comprises a beam for connecting one of said pedals to the sleeve of a related one of the axle units.

* * * * *